US007963242B2

(12) United States Patent
Wiggin et al.

(10) Patent No.: US 7,963,242 B2
(45) Date of Patent: Jun. 21, 2011

(54) ANCHOR CONTAINING A SELF DEPLOYING MOORING SYSTEM AND METHOD OF AUTOMATICALLY DEPLOYING THE MOORING SYSTEM FROM THE ANCHOR

(75) Inventors: Thomas S. Wiggin, Jamestown, RI (US); David A. Sharp, Newport, RI (US); Marc A. Brown, Tubac, AZ (US); Christopher C. Mello, Newport, RI (US); Frank H. Hitzke, Sarona, WI (US); David A. Giroux, South Kingstown, RI (US); Douglas L. Veilleux, II, Rochester, MA (US); Emily J. Pikor, Bristol, RI (US); Edward M. Gaboriault, Jr., Lincoln, RI (US)

(73) Assignee: Raytheon Company, Waltham, MA (US)

( * ) Notice: Subject to any disclaimer, the term of this patent is extended or adjusted under 35 U.S.C. 154(b) by 300 days.

(21) Appl. No.: 12/207,762

(22) Filed: Sep. 10, 2008

(65) Prior Publication Data

US 2010/0068955 A1 Mar. 18, 2010

(51) Int. Cl.
*B63B 21/24* (2006.01)

(52) U.S. Cl. ..... 114/293

(58) Field of Classification Search ..... 114/293, 114/294

See application file for complete search history.

(56) References Cited

U.S. PATENT DOCUMENTS

| | | | | |
|---|---|---|---|---|
| 3,638,338 | A * | 2/1972 | Nelson | 37/308 |
| 5,932,815 | A * | 8/1999 | Dodds | 73/862.393 |
| 5,944,448 | A | 8/1999 | Williams | |
| 6,558,215 | B1 | 5/2003 | Boatman | |
| 7,179,145 | B2 * | 2/2007 | Driscoll et al. | 441/7 |
| 7,244,155 | B1 | 7/2007 | Nye et al. | |
| 2008/0210489 | A1 * | 9/2008 | Ashmus | 182/75 |

FOREIGN PATENT DOCUMENTS

| | | |
|---|---|---|
| GB | 2 231 845 | 11/1990 |
| NL | 1017854 | 10/2002 |

OTHER PUBLICATIONS

Notification of Transmittal of the International Search Report and the Written Opinion for PCT/US2009/054144 dated Aug. 18, 2009., 11 pages.

PCT International Preliminary Report on Patentability of the ISA dated Apr. 14, 2011 for PCT Pat. App. No. PCT/US2009/054144.

* cited by examiner

*Primary Examiner* — Stephen Avila

(74) *Attorney, Agent, or Firm* — Daly, Crowley, Mofford & Durkee, LLP

(57) ABSTRACT

An anchor holds a variety of mooring system elements, including processor-controlled cable brakes, prior to deployment of the anchor. The anchor is configured to automatically deploy the elements of the mooring system into a desired underwater configuration. A method of deploying an ocean anchor includes controlling cable brakes and results in the elements of the mooring system being deployed into a desired underwater configuration.

21 Claims, 11 Drawing Sheets

ANCHOR CONTAINING A SELF DEPLOYING MOORING SYSTEM AND METHOD OF AUTOMATICALLY DEPLOYING THE MOORING SYSTEM FROM THE ANCHOR

STATEMENT REGARDING FEDERALLY SPONSORED RESEARCH

This invention was made with government support under Grant Number N00039-04-C-0035 by the Department of the Navy. The Government has certain rights in the invention.

CROSS REFERENCE TO RELATED APPLICATIONS

Not Applicable.

FIELD OF THE INVENTION

This invention relates generally to mooring systems and methods and, more particularly, to an anchor that contains a self-deploying mooring system and associated float, which can automatically deploy in the ocean and a method associated therewith.

BACKGROUND OF THE INVENTION

A variety of types of simple passive mooring systems are known, which anchor a ship or a buoy in the ocean, and in particular in relatively shallow regions close to a coast line. A conventional mooring system will be understood to include a passive anchor placed on the bottom of the ocean, and a rope, cable, and/or a chain, which couples the anchor to the ship or buoy, keeping the ship or buoy generally at the same position.

Some types of conventional mooring systems are more complex. Particularly mooring systems that are used in deeper water, for example, greater than five hundred feet, may also include sub-surface floats coupled to the rope, cable, and/or chain in order to lift a portion of the rope, cable, and/or chain that would otherwise lay on the bottom of the ocean.

Some types of conventional mooring systems used to moor a ship are deployed from the ship, wherein the anchor is dropped into the water and the anchor pulls the rope, cable, and/or chain into the water at relatively high speed as it drops to the ocean bottom.

Some types of conventional mooring systems used to moor a buoy rather than a ship are also deployed from a ship, wherein the anchor is dropped into the water and the anchor pulls the rope, cable, and/or chain into the water at relatively high speed as it drops to the ocean bottom. The rope, cable, and/or chain is coupled to the buoy. The buoy can be manually deployed into the water with a crane or the like.

It will be recognized that the deployment of a mooring system and associated buoy, and, in particular, the associated rope, cable, and/or chain, can be cumbersome, time consuming, and dangerous. Manual deployment of the rope, cable, and/or chain can also result in tangles.

SUMMARY OF THE INVENTION

The present invention provides an anchor capable of automatically deploying a mooring system into a desired configuration in a simple, safe, and rapid way.

In accordance with one aspect of the present invention, an anchor includes a frame and a capstan coupled to the frame. The capstan comprises a capstan shaft and a capstan hub coupled to the capstan shaft, wherein the capstan hub is configured to rotate about the capstan shaft. The anchor further includes a riser cable in contact with the capstan hub, wherein the capstan is configured to deploy the riser cable from the anchor around the capstan hub. The anchor further includes a least one brake coupled to the capstan shaft or to the capstan hub. The anchor further includes a processor configured to provide a braking control signal to the at least one brake. The at least one brake is configured, in response to the braking control signal, to retard a speed of rotation of the capstan hub, resulting in at least one of a retardation of a speed of deployment of the riser cable or a retardation of a speed of decent of the anchor. The anchor further includes a float. The anchor is configured to hold the float and is configured to deploy the float from the anchor.

In accordance with another aspect of the present invention, a method of deploying an ocean anchor includes releasing a float, measuring a rate of decent of the anchor, and measuring a depth of the anchor. The method also includes measuring a payout rate or a payout length of a riser cable coupled at one end to the anchor. The method also includes selecting a braking value in accordance with at least one of the rate of decent, the payout rate, or the payout length and generating a braking signal in accordance with the braking value. The method further includes applying the braking signal to one or more brakes associated with the riser cable.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "buoyancy" refers to a sum of a buoyant force and a gravitational force. An object that has positive buoyancy will tend to float, and an object that has negative buoyancy will tend to sink. An object that is neutrally buoyant will tend to neither sink nor float.

As used herein, the term "mid-water float" is used to describe a float (i.e., a structure having positive buoyancy) used in a mooring system that maintains a position substantially under the surface of the water, for example, two hundred feet under the surface of the water by way of a combination of cable forces and buoyancy. The function of a mid water float is to help to lift a portion of a mooring cable associated with the mooring system.

As used herein, the term "riser cable" is used to describe a part of a mooring cable between an anchor and the mid-water floats. As used herein, the term "tether cable" is used to describe a part of a mooring cable between the mid-water float and a surface or near surface structure, for example, a surface float. As used herein, the term "mooring cable" is used to include both the riser cable and the tether cable. While the mid-water floats may be at or near a junction between the riser cable and the tether cable, the mid-water floats can also be at another position along the mooring cable.

Figure 1:
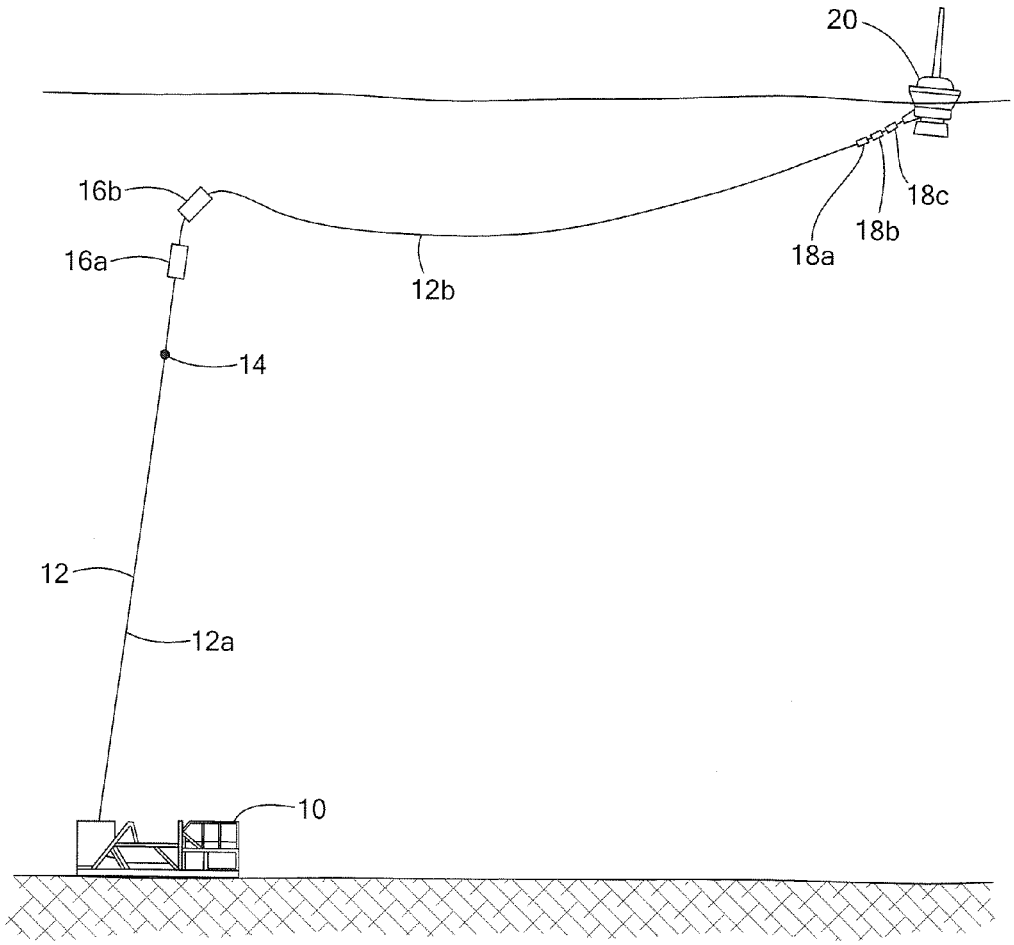
FIG. 1 is a pictorial showing a mooring system having an anchor, two mid-water floats, three sub-surface floats, a riser cable coupled to the anchor, and a tether cable coupled to a surface float (or buoy)

Referring to FIG. 1, an exemplary mooring system includes an anchor 10 coupled to a mooring cable 12 having a lower portion 12*a* (also referred to herein as a "riser cable") coupled to an upper portion 12*b* (also referred to herein a an "upper tether cable"). The mooring cable 12 can include strength member portion and communication portions, for example, wires or fiber optic links.

In some arrangements, the riser cable 12*a* is configured to be neutrally buoyant or nearly neutrally buoyant and the tether cable 12*b* is configured to be negatively buoyant. However, in other arrangements, the upper tether cable 12*b* is configured to be neutrally buoyant or nearly neutrally buoyant. In some arrangements, the upper tether cable 12*b* is armored with a steel mesh or the like. In some arrangements, the riser cable 12*a* is armored with Kevlar or the like.

The mooring system can include a rotary joint 14. The mooring system can also include one or more mid-water floats 16*a*, 16*b* coupled at or near to the top of the riser cable 12*a* and one or more sub-surface floats 18*a*-18*c* coupled to the upper tether cable 12*b* near the float.

In some embodiment, the mid-water floats have a combined positive buoyancy of about four thousand pounds in seawater. In some embodiments, the mid-water floats are hollow and are constructed from Aluminum.

As will become apparent from the discussion in conjunction with figures below, that the mooring system can also include a float 20 coupled to the upper tether cable 12*b*, which can be either a surface float as shown, or a sub-surface float.

In a conventional mooring system, the anchor is essentially separate from the various other parts of the mooring system. However, as will become apparent from discussion below, in the mooring system described herein, the mooring cable 12, the mid-water floats 16*a*, 16*b*, the rotational coupling 14, the sub-surface floats 18*a*-18*c*, and even the float 20, which is the object to be moored, can all be stowed upon or within the anchor 10 prior to deployment of the anchor 10 and can automatically deploy from the anchor 10. Therefore, the mooring cable 12, the mid-water floats 16*a*, 16*b*, the rotational coupling 14, the sub-surface floats 18*a*-18*c*, and the float 20 can be considered to be part of the anchor 10 prior to deployment and separate from the anchor 10 after deployment.

While two mid-water floats 16*a*, 16*b* are described above, in other embodiments, there can be more that two or fewer than two mid-water floats.

Figure 2:
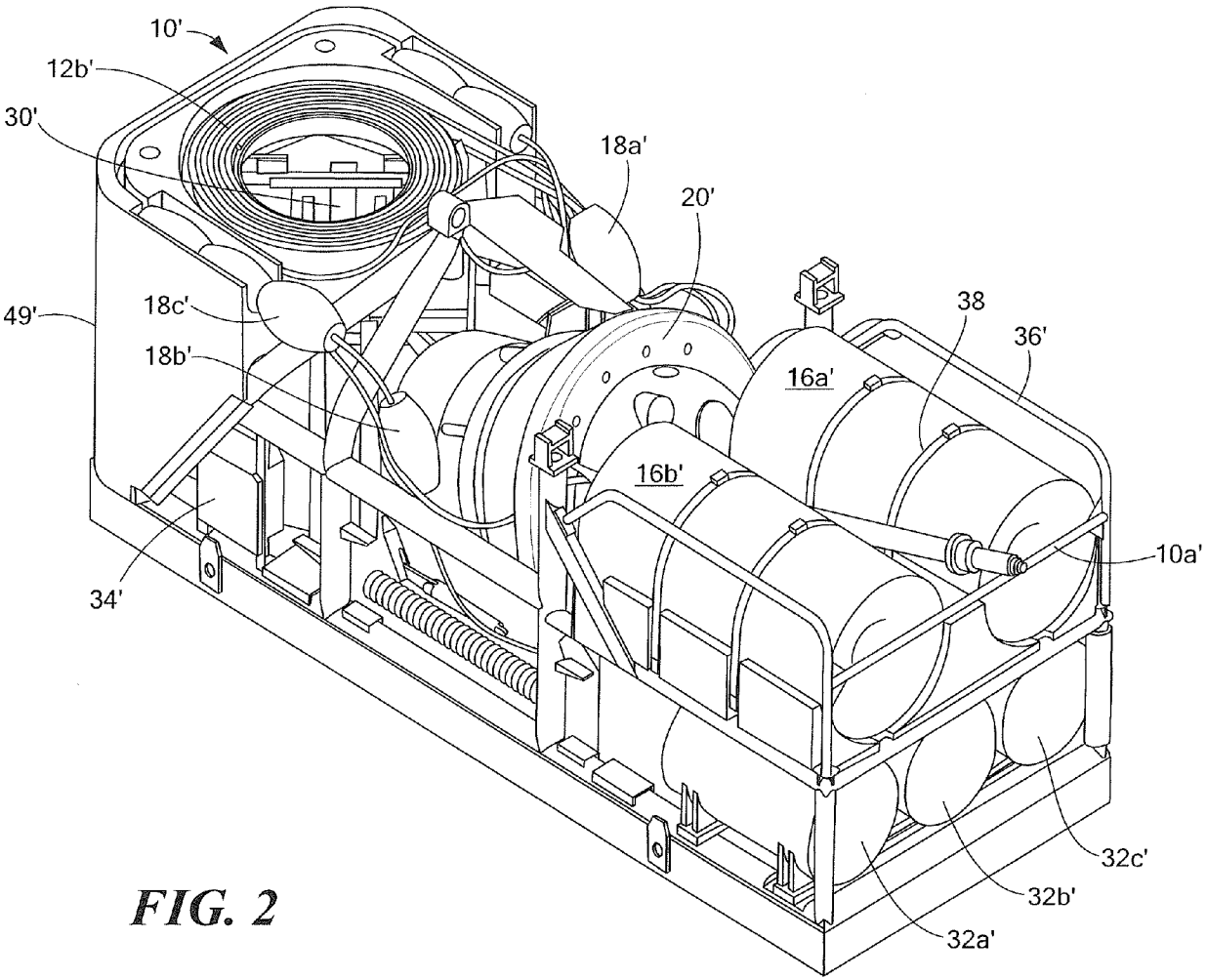
FIG. 2 is a perspective view showing the anchor of FIG. 1 before deployment, wherein the anchor holds the tether cable, the riser cable and an associated capstan, the two mid-water floats, the three sub-surface floats, and the surface float.

Referring now to FIG. 2, like elements of FIG. 1 are shown having like reference designations, but with a prime symbol (') indicating that those elements are shown to be stowed upon or within the anchor 10' prior to deployment in the ocean, but that those elements automatically achieve a deployed configuration as shown in FIG. 1 once the anchor 10' is deployed into the ocean. The prime symbol (') is similarly used is other figures below for the same purpose.

The anchor 10' can include a frame 10*a*', and the anchor 10' can be used to stow, and therefore includes prior to deployment, the float 20', the upper tether cable 12*b*', and the two mid-water floats 16*a*', 16*b*'. The rotational coupling 14 and the riser cable 12*a* are not readily visible in FIG. 2.

The mid-water floats 16*a*', 16*b*' can be held in position by straps, or which a strap 38 is but one example. The straps, e.g., the strap 38, and release thereof are shown in greater detail below in conjunction with FIG. 5.

The float 20' can be of a type described in U.S. Provisional Patent Application No. 61/031,551, filed Feb. 26, 2008, which patent application is incorporated by reference herein in its entirety. However, the float 20' can also be another type of float or even a sub-surface float.

The anchor 10' can also include cable packs, for example, three cable packs 32*a*'-32*c*', which hold trunk cable. The trunk cable can be, for example, part of an acoustic array, which can be coupled to the anchor after the associated mooring system is deployed. The trunk cable and acoustic array are describe more fully in the above-described U.S. Provisional Patent Application No. 61/031,551, filed Feb. 26, 2008, but are not discussed again here.

The anchor 10' can also include a power source 34', for example, batteries. The anchor 10' can also include flexible side panels 36' surrounding part of or all of the anchor 10'. The flexible side panels 36' can influence the hydrodynamic drag of the anchor 10' as it falls through the water, and can influence the stability of the anchor 10' as it falls. The flexible side panels 36' can also protect the anchor 10' from being damaged by the effects of heat from the sun, for example, when on the deck of a ship.

The anchor 10' can also include a capstan 30' about which at least the riser cable 12*a* can be deployed. The capstan 30' is described more fully below in conjunction with FIG. 6.

Figure 3:
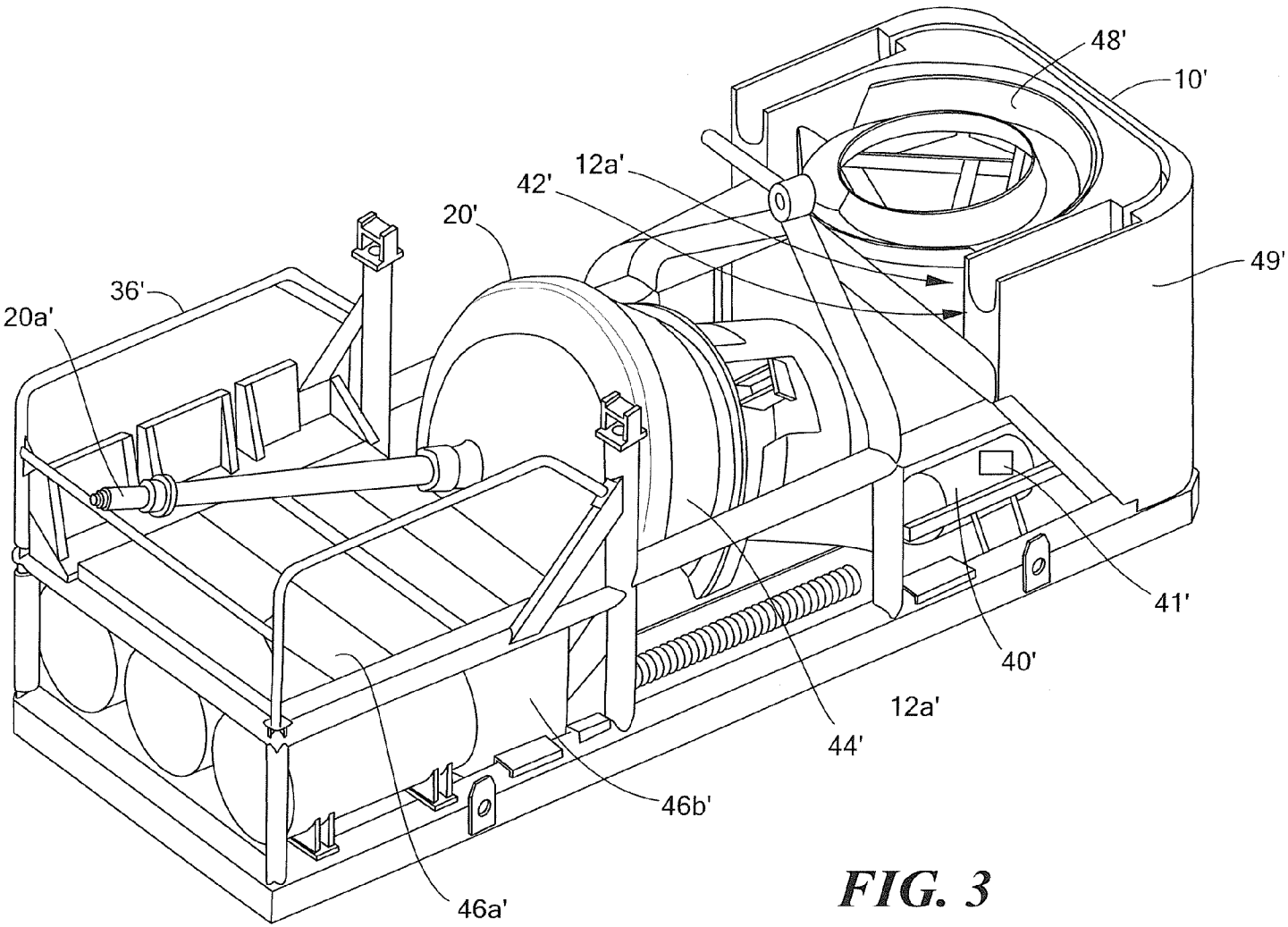
FIG. 3 is another perspective view showing the anchor of FIG. 1 before deployment.

Referring now to FIG. 3, in which like elements of FIGS. 1 and 2 are shown having like reference designations, the anchor 10' includes an electronic assembly 40' having a processor therein. The electronic assembly 40' can be powered by the power source 34' of FIG. 2. The anchor 10' is shown without the mid-water floats 16*a*', 16*b*' of FIG. 2, in which case a mast portion 20*a*' of the float 20' is more visible.

The anchor 10' can include a depth sensor 41', for example, a pressure sensor, in communication with the electronic assembly 40'.

The anchor 10' can include rear ballast tanks 46*a*', 46*b*', used during parts of the deployment sequence described more fully below. The rear ballast tanks 46*a*', 46*b*' can be flooded by way of valves, not shown, under control of the electronics assembly 40'.

The anchor 10' can include a front ballast tank 49', used during parts of the deployment sequence described more fully below. The front ballast tank 49' can be flooded by way of valves, not shown, under control of the electronics assembly 40'. However, in other embodiments, the front ballast tank 49' can be flooded by way of a pressure-released poppet valve (not shown). In some embodiments, the pressure-released poppet valve opens at a relatively shallow depth, for example, twenty feet, resulting in the front ballast tank becoming entirely flooded at approximately the same time that the mid-water floats 16*a*', 16*b*' are released.

In some arrangements, when not yet flooded, the ballast tanks provide a positive buoyancy of about 3250 pounds in seawater.

Figure 9:
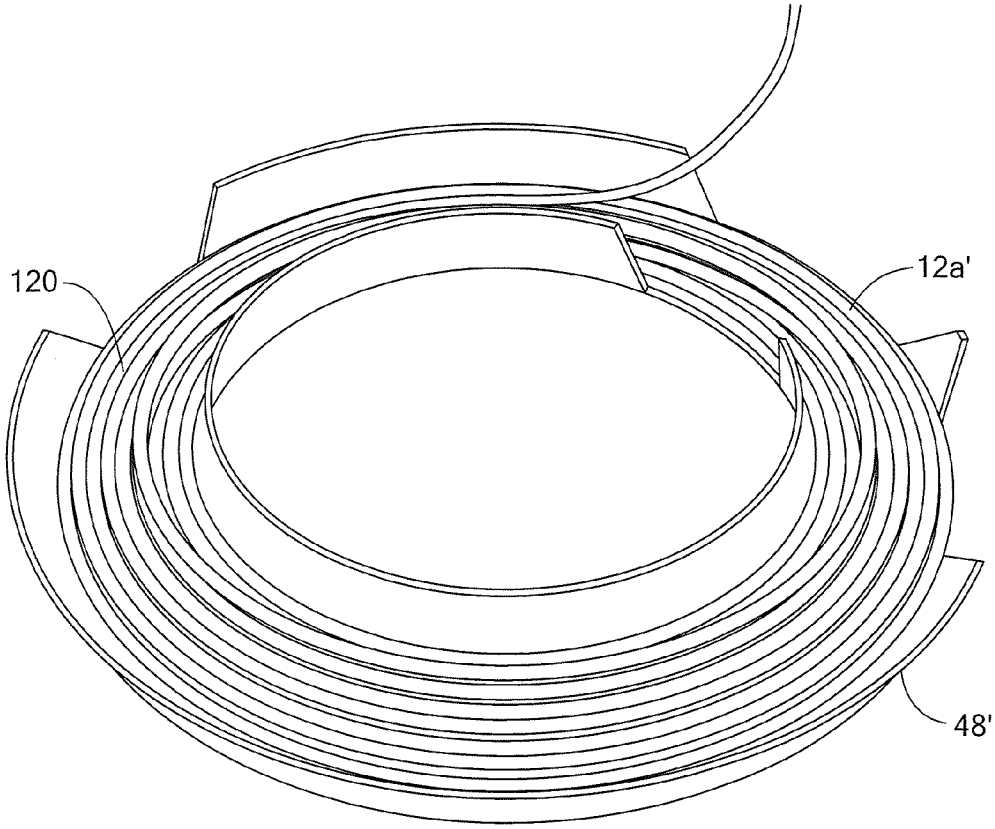
FIGS. 9 and 9A are diagrams that show a stowed configuration of the tether cable of FIGS. 1-3.
Figure 9A:
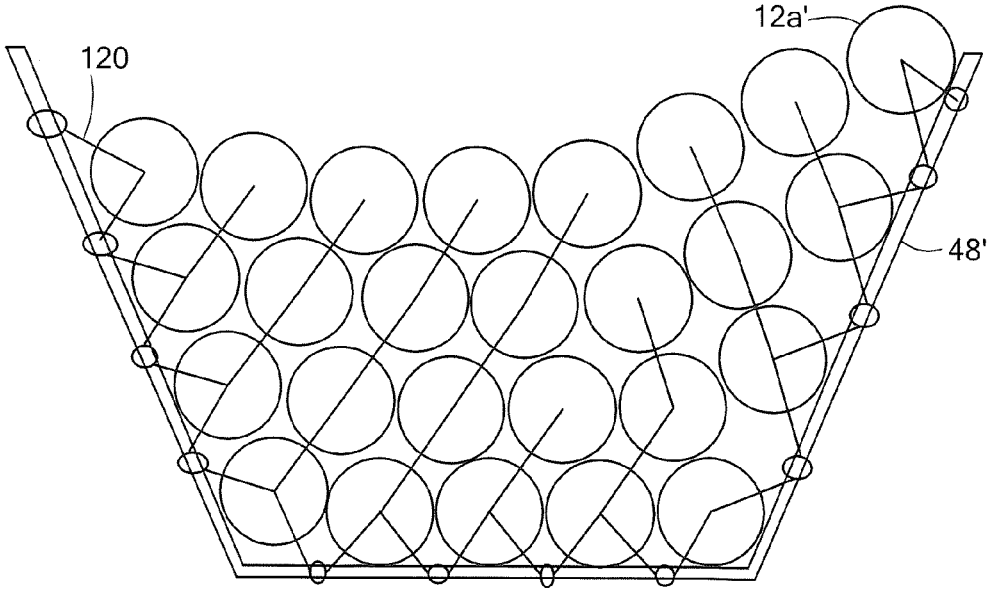

The anchor 10' can include a riser cable tray 42' configured to hold the riser cable 12*a*', which can deploy about the capstan 30' of FIG. 2. The anchor 10' can also include a tether cable tray 48' configured to hold the tether cable 12*b*' (FIG. 2), which does not deploy around the capstan 30'. FIGS. 9 and 9A describe further details regarding deployment of the tether cable 12*b'*.

The float 20' can be held in place by a deployable strap 44' prior to deployment of the float 20'. The strap 44' and release thereof are shown in greater detail below in conjunction with FIG. 4.

It will be come apparent from discussion below, that when the anchor 10' is deployed into the ocean, first the float 20' is released and separates from the anchor 10', the anchor 10' then sinks while coupled to the float 20' by the upper tether cable 12*b*, which pays out of the anchor 10', the mid-water floats 16*a*', 16*b*' are released, the riser cable 12*b*' pays out from the riser cable tray 42' and around the capstan 30', and the anchor 10' lands on the bottom of the ocean. The deployment sequence is described below in greater detail.

Figure 4:
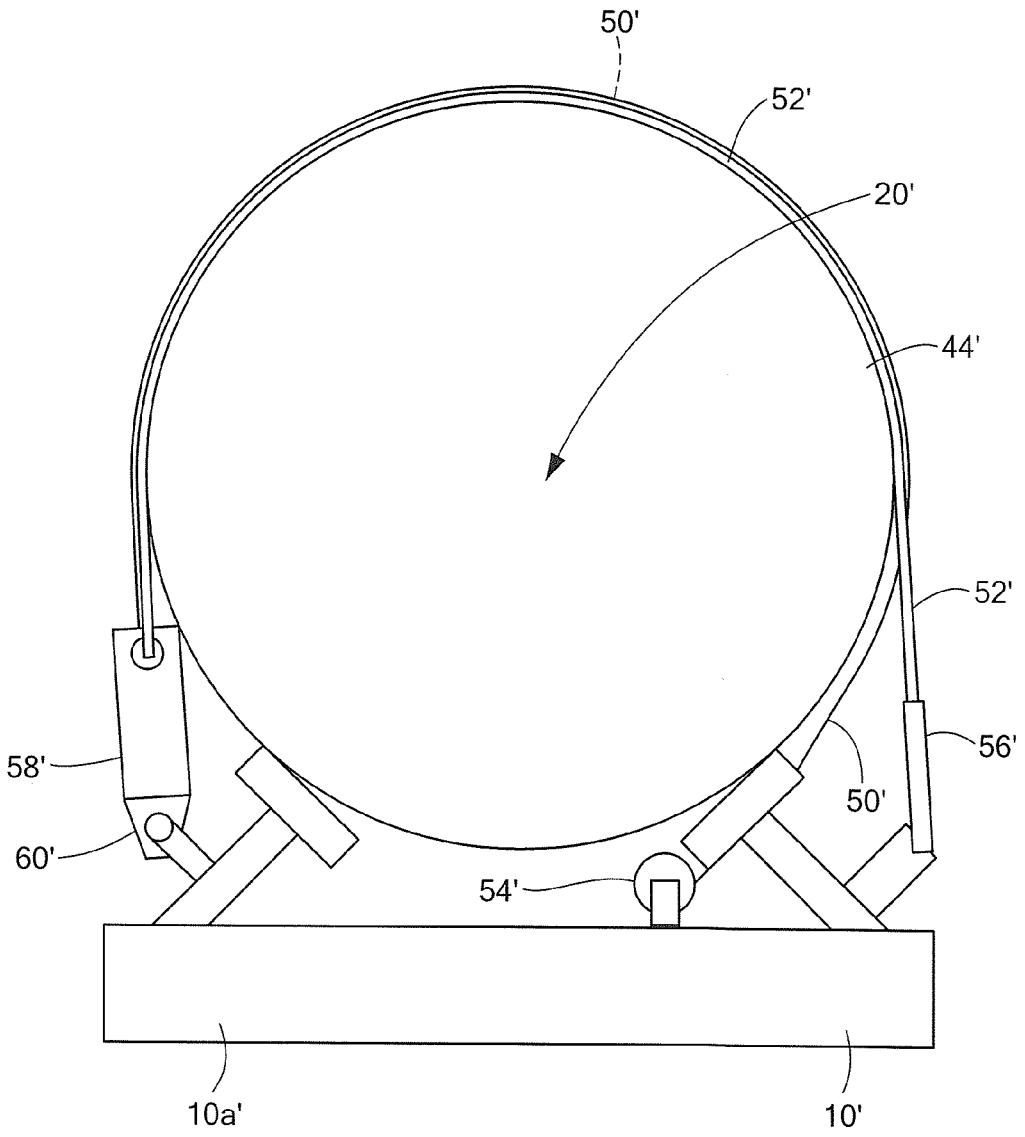
FIG. 4 is a diagram showing a strap assembly to hold the surface float of FIGS. 1-3 into the anchor of FIGS. 1-3 and to release the surface float from the anchor.

Referring now to FIG. 4, in which like elements of FIGS. 1-3 are shown having like reference designations, the anchor 10' includes the float 20', which prior to deployment of the float 20', is held in position by the strap 44'. In one particular embodiment, the strap 44' comprises both a retractable strap 50' held taught by a spring reel 54', and also a tensioned tie down strap 52', which can be tensioned with a tensioning screw device 56 or the like.

The strap 44' can be coupled to the anchor frame 10*a*' with a release mechanism 58'. In some embodiments, the release mechanism 58' is an electrically actuated release mechanism controlled by the electronics assembly 40' of FIG. 3. The release mechanism 58' can be coupled to the frame 10*a*' with a hinge 60'. In operation, the release mechanism 58' separates upon actuation by the electronics assembly 40', thereby causing the strap 44' to open, causing the float 20' to separate from the frame 10*a*', and therefore from the anchor 10' by its own buoyancy. The spring reel 54 can reel in the retractable strap 50', and therefore the tie-down strap 52', preventing entanglement with other hardware to be released.

Figure 5:
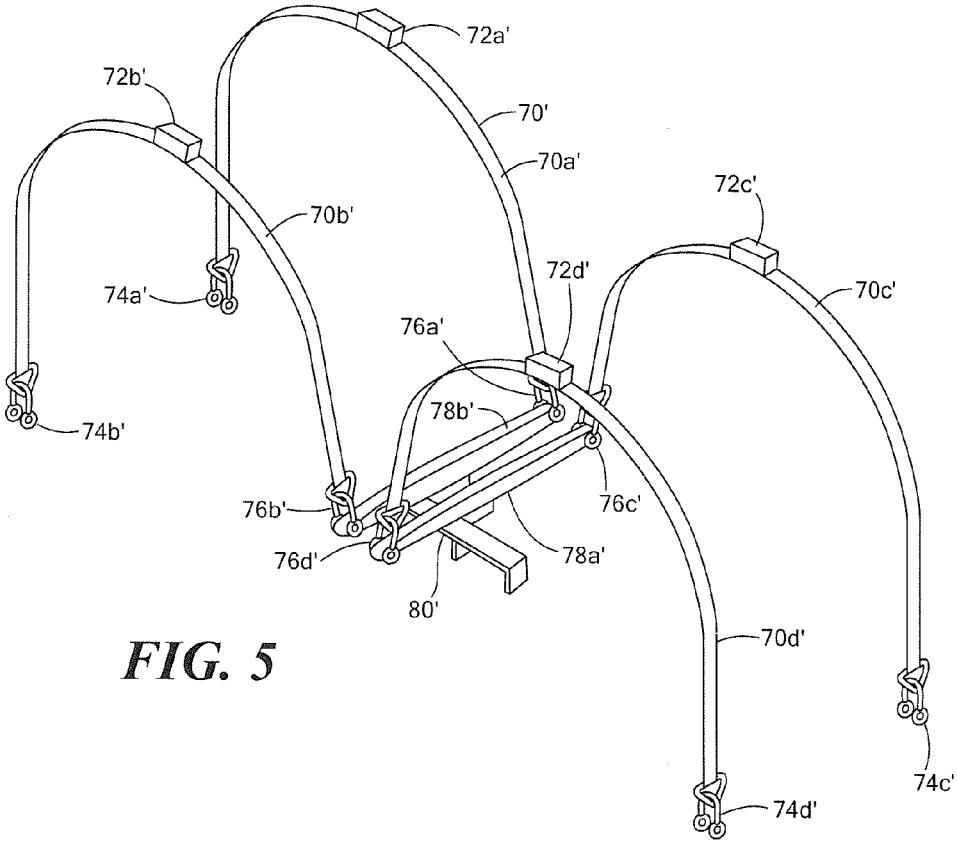
FIGS. 5 and 5A are diagrams showing a strap assembly to hold the mid-water floats of FIGS. 1-3 into the anchor of FIGS. 1-3 and to release the mid-water float from the anchor.
Figure 5A:
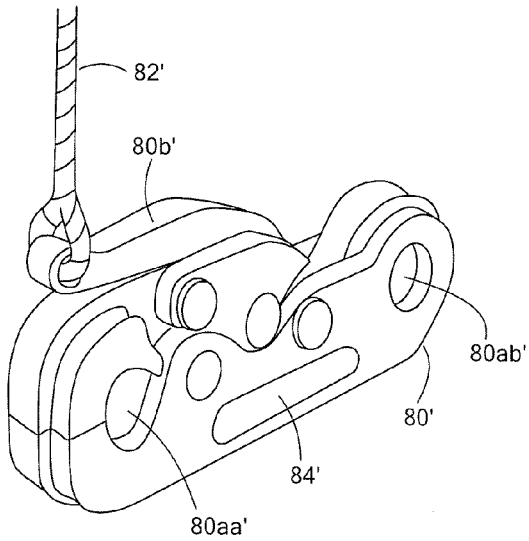

Referring now to FIGS. 5 and 5A, in which like elements of FIGS. 1-3 are shown having like reference designations, straps 70*a*-70*d*' can be the same as or similar to the strap 38*a* of FIG. 2. The straps 70*a*-70*d*' retain the mid-water floats 16*a*', 16*b*' (FIG. 2) to the anchor 10'. Each strap can include a respective ratcheting (i.e., tightening) mechanism 72*a*'-72*d*' configured to allow manual tightening of the straps 70*a*'-70*d'*.

Ends 74*a*'-74*d*' of the straps 70*a*'-70*d*' can be coupled to the frame 10*a*' of the anchor 10'. Ends 76*a*'-76*d*' of the straps 70*a*'-70*d*' can be coupled to bars 78*a*', 78*b*', which couple to the frame 10*a*' via a retention mechanism 80' (also 80' of FIG. 5A).

The retention mechanism 80' can couple to the bars 78*a*', 78*b*' with rods (not shown) through holes 80*aa*', 80*ab*'. The retention mechanism 80' can include a lever 80*b*, which can be actuated by a cord 82.

In operation, at a time during the deployment of the anchor 10' described more fully below, the retention mechanism 80' is actuated, i.e., the lever 80*b* is pulled, therefore releasing the bars 78*a*', 78*b*' from the frame 10*a*', and therefore, releasing the mid-water floats 16*a*', 16*b*' from the anchor 10'.

In some embodiments, the cord 82' can be coupled to close to the deepest end of the upper tether cable 12*b*' of FIG. 2. Therefore, when the upper tether cable 12*b*' is fully deployed as is the upper tether cable 12*b* of FIG. 1, the retention mechanism 80' becomes actuated, the mid-water floats 16*a*, 16*b* (FIG. 1) are released from the anchor 10', and the cord 82' breaks In some other embodiments, the release mechanism 80' is electrically actuated, for example, via the electronic assembly 40' if FIG. 3.

In some embodiments, the release mechanism 80' includes a release sensor 84' in communication with the electronic assembly 40' (FIG. 2), in order to indicate to the electronic assembly 40' when the mid-water floats 16*a*', 16*b*' (FIG. 2) have been deployed from the anchor 10'.

Figure 6:
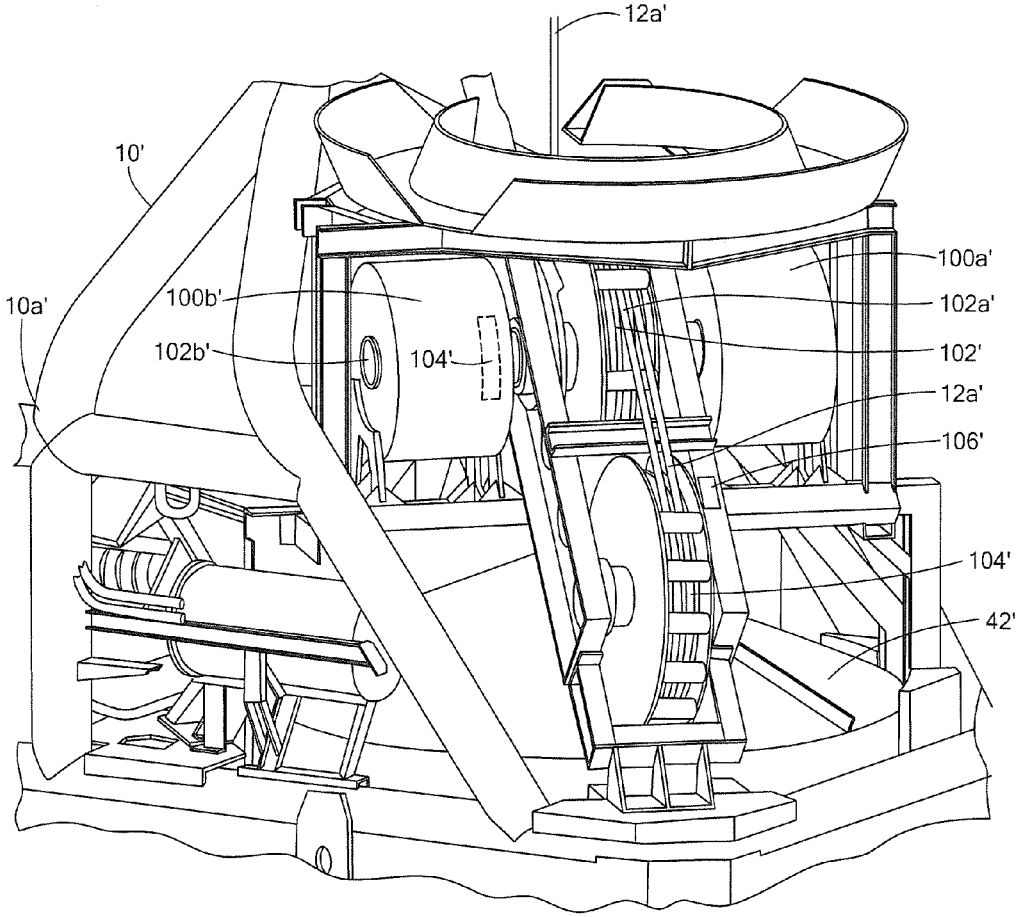
FIG. 6 is a perspective drawing showing a capstan, which is a part of the anchor of FIGS. 1-3, which is used to deploy the riser cable of FIGS. 1-3 from the anchor.

Referring now to FIG. 6, in which like elements of FIGS. 1-3 are shown having like reference designations, the anchor 10' includes the riser cable tray 42' also shown in FIG. 3, in which the riser cable 12*a*' is contained. The riser cable 12*a*' emerges from the riser cable tray 42', and passes to a capstan 102'. The capstan 102' can be the same as or similar to the capstan 30' of FIG. 2. The capstan 102' can includes a capstan hub 102*a*' and a capstan shaft 102*b*' about which the capstan hub 102*a*' can rotate. The riser cable 12*a*' passes over a feed pulley 104' and passes to and around the capstan hub 102*a*'. Two brakes 100*a*', 10*b*' are coupled to the capstan shaft 102*b*' and are operable to apply a braking force to the capstan shaft 102*b*', and therefore, to the capstan hub 102*a'*.

The anchor 10', and the capstan 102' in particular, can include a rotation sensor 104' configured to generate a rotation signal communicated to the electronic assembly 40' (FIG. 3). The rotation signal is indicative of rotations of the capstan hub 102*a*', and therefore, to a length of the riser cable 12*a*' deployed from the tray 106'.

In addition to or in place of the rotation sensor 104', the anchor 10' can include a payout length sensor 106'. The payout length sensor 106' is configured to generate a payout length signal communicated to the electronic assembly 40' (FIG. 3). The payout length signal is indicative of a measure payout length of the riser cable 12*a*' deployed from the tray 106'. In some arrangements, the payout length sensor 106' is an optical sensor configured to count features, for example, stripes, upon the riser cable 12*a'*.

The brakes 100*a*', 100*b*' are responsive to a braking control signal provided by the electronic assembly 40' of FIG. 3. In response to the braking control signal, the brakes 100*a*', 100*b*' are configured to retard a speed of rotation of the capstan hub 102*a*', resulting in at least one of a retardation of a speed of deployment of the riser cable 12*a*' or a retardation of a speed of decent of the anchor 10'. Deployment of the anchor 10' and operation of the brakes 102*a*', 102*b*' is described more fully below in conjunction with FIGS. 7-10A.

In some embodiments, each one of the two brakes 100*a*', 110*b*' is configured to be able, in response to the braking control signal, to apply to the capstan hub 102*a*' at least a zero braking force, a first braking force greater than the zero braking force, and a second braking force greater than the first braking force, wherein different combinations of the braking forces of the two brakes 10*a*', 110*b*' results in at least the zero braking force, a low braking force, a medium braking force, a high braking force, and a highest braking force applied to the capstan hub 102*a'*.

In some embodiments, the first braking force is about half of the second braking force. In some embodiments, the low braking force, the medium braking force, and the high braking force, are about a quarter, a half, and three quarters of the highest braking force, respectively.

In some other embodiments, the two brakes 100*a*', 100*b*' are configured to be able, in response to the braking control signal, to apply to the capstan hub 102*a*' a variable braking force, for example, a braking force anywhere between the zero braking force and the highest braking force.

In some other embodiments, there are more than or fewer than the two brakes 10*a*', 100*b*', including one brake.

Figure 7:
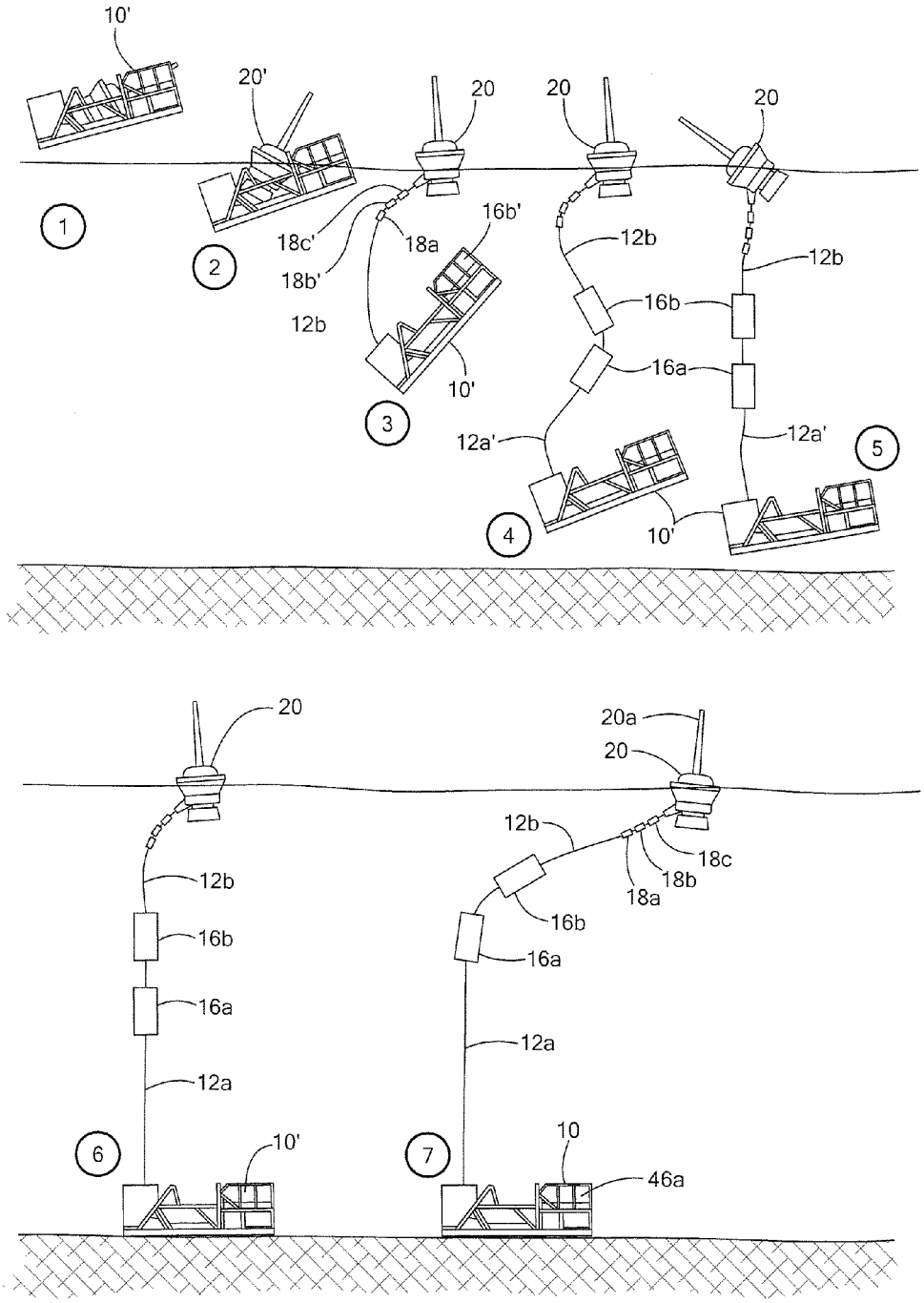
FIG. 7 is a diagram showing a deep water deployment sequence of the mooring system of FIG. 1.

Referring now to FIG. 7, in which like elements of FIGS. 1-3 are shown having like reference designations, and which includes frames numbered 1-7, in frame 1, the anchor 10' is deployed into relatively deep water, for example water having a depth of greater than about four hundred feet. At frame 2, the float 20' begins to release from the anchor 10', for example via the release mechanism 58' of FIG. 4, which is under control of the electronic assembly 40' of FIG. 2. At frame 3, the float 20 is fully deployed and the anchor 10' falls relatively slowly through the water, deploying the upper tether cable 12*b* and the floats 18*a*-18*c* therefrom. The anchor 10' tends to fall relatively slowly because the mid-water floats 16*a*', 16*b*', which are positively buoyant, remain coupled to the anchor 10', and also because the ballast tanks 46*a*', 46*b*' of FIG. 3 remain unfilled, therefore also having positive buoyancy.

In some embodiments, the upper tether cable 12*b* is about four hundred feet long, therefore, when the anchor 10' achieves a depth of about four hundred feet, the upper tether cable 12*b* is fully deployed.

At flame 4, after the upper tether cable 12*b* is fully deployed at flame 3, the mid-water floats 16*a*, 16*b* are released, for example, via the release mechanism described above in conjunction with FIG. 5A mechanically actuated by the cord 82 coupled to the upper tether cable 12*b*, and the riser cable 12*a*' begins to deploy.

Once the mid-water floats 16*a*, 16*b* are deployed, the anchor 10' would tend to fall more rapidly through the water were it not for tension kept on the riser cable 12*a*' by operation of the capstan 102' (FIG. 6) and associate brakes 100*a*', 100*b*' (FIG. 6), particularly shown in frame 5. In frame 5, the tension upon the riser cable 12*a*' maybe sufficient to cause the float 20 to tilt, depending upon a location of an attachment point between the upper tether cable 12*b* and the float 20.

Without the tension upon the riser cable 12*a*', as the anchor 10' descends through the water, the anchor 10' might tend to fall too rapidly, which could result in an unstable decent of the anchor 10', causing the riser cable 12*a*' to tangle. A decent that is too fast might also cause damage to the anchor when it lands upon the bottom of the ocean. Furthermore, it is desirable to keep the mid-water floats 16*a*', 16*b*' from rising to the surface during the deployment of the anchor 10'.

At frame 6, the anchor has descended to the ocean bottom, but the riser cable 12*a*' may not yet be fully deployed. The riser cable 12*a*' may continue to deploy under control of the electronic assembly 40' (FIG. 3) and the capstan 102' (FIG. 6), as described more fully below in conjunction with FIGS. 10 and 10A.

At frame 7, the rear ballast tanks (e.g., 46*a*) can be flooded. At this time, the riser cable 12*a* and all elements of the anchor 10 are fully deployed.

In some embodiments, the rear ballast tanks are flooded in conjunction with frames 5 or 6, rather than in conjunction with frame 7.

As described in the above-mentioned U.S. Provisional Patent Application No. 61/031,551, filed Feb. 26, 2008, if the float 20 is a communication float, it is desirable that the float 20 remain at an orientation so that the mast 20*a* is nearly vertical over a range of sea states and weather conditions. This is to allow for an RF signal transmitted by the float 20 to maintain communication in view of a transmitting beampattern associated with the antenna mast 20*a*. The orientation of the float 20 is generally achieved by way of the floats 18*a*-18*c* in combination with the mid-water floats 16*a*, 16*b*, and in combination with the point at which the upper tether cable couples to the float 20.

The above-described deployment applies to water depths sufficiently deep that the mid-water floats 16*a*, 16*b* can be deployed. As will become apparent from the discussion below in conjunction with FIG. 8, the deployment in shallower water may be slightly different.

Figure 8:
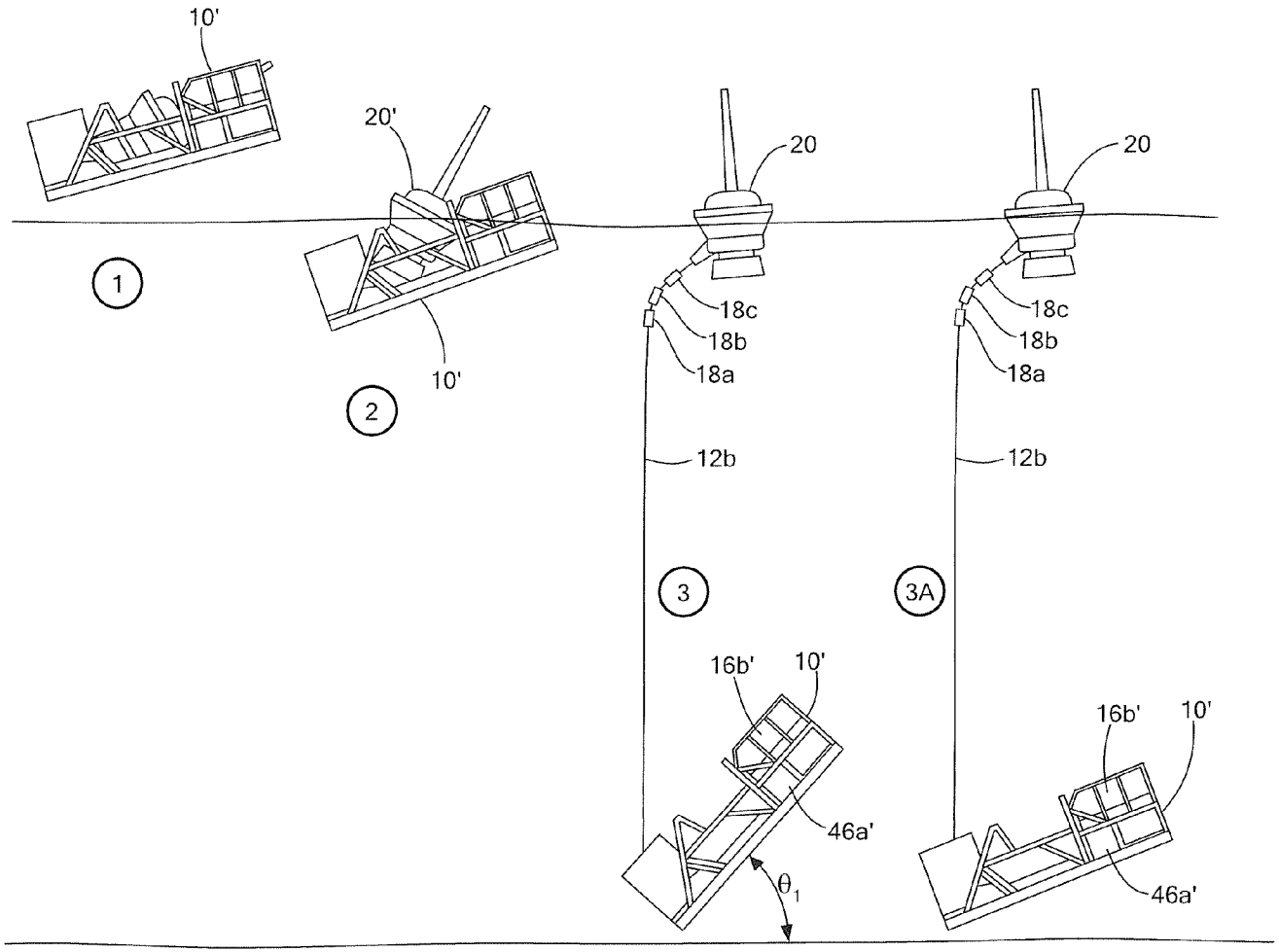
FIG. 8 is a diagram showing a shallow water deployment sequence of the mooring system of FIG. 1.

Referring now to FIG. 8, in which like elements of FIGS. 1-3 are shown having like reference designations, and which includes frames 1-3A, in frame 1, unlike the sequence shown in conjunction with FIG. 7, the anchor 10' is deployed into relatively shallow water, for example water having a depth of less than about four hundred feet. At frame 2, the float 20' begins to release from the anchor 10', for example via the release mechanism 58' of FIG. 4, which is under control of the electronic assembly 40' of FIG. 2. At frame 3, the float 20 is fully deployed and the anchor 10' falls relatively slowly through the water, deploying the upper tether cable 12*b* and the floats 18*a*-18*c* therefrom. As described above in conjunction with FIG. 7, the anchor 10' tends to fall relatively slowly because the mid-water floats 16*a*', 16*b*', which are positively buoyant, remain coupled to the anchor 10', and also because the rear ballast tanks 46*a*', 46*b*' of FIG. 3 remain unfilled, therefore also having positive buoyancy.

Also at frame 3, the anchor 10' contacts the ocean bottom, which, as described above is relatively shallow. The anchor 10' may contact the ocean bottom at an angle θ resulting from positive buoyancy generated by the mid-water floats (e.g., 16*b*') and by the empty rear ballast tanks (e.g., 46*a*').

At frame 3A, the rear ballast tanks (e.g., 46*a*') can be flooded under control of the electronic assembly 40' FIG. 3, resulting is the angle θ being reduced so that the anchor 10' lies flat on the ocean floor.

At this time, the anchor 10' is still only partially deployed, but the anchor 10' may sit in this condition until such time that the mid-water floats (e.g., 16*b*') are pulled from the anchor 10' by operation of weather (wind, waves, etc.) acting upon the float 20.

Once the mid-water floats (e.g., 16*b*') are pulled from the anchor 10', deployment continues as in frames 4-7 of FIG. 7.

Referring now to FIGS. 9 and 9A, in which like elements of FIGS. 1-3 are shown having like reference designations, the upper tether cable 12*b*' is shown coiled within the tether cable tray 48' and held in position by a plurality of structures, of which a structure 120 is but one example. In some embodiments, the structures, e.g., the structure 120, are nylon or plastic cable ties, which are conventionally used to secure cables. Each wrap of the tether cable 12*a*' is coupled to another wrap of the tether cable 12*a*' beneath it, and the bottom wraps of the tether cable 12*a*' are coupled to the tether cable tray 48'

The cable ties are selected to have a braking strength that will allow them to break due to the positive buoyancy of the float 20 (FIGS. 7 and 8) in combination with the negative buoyancy of the anchor 10' (FIGS. 7 and 8), for example at frame 3 of FIG. 7.

Figure 10:
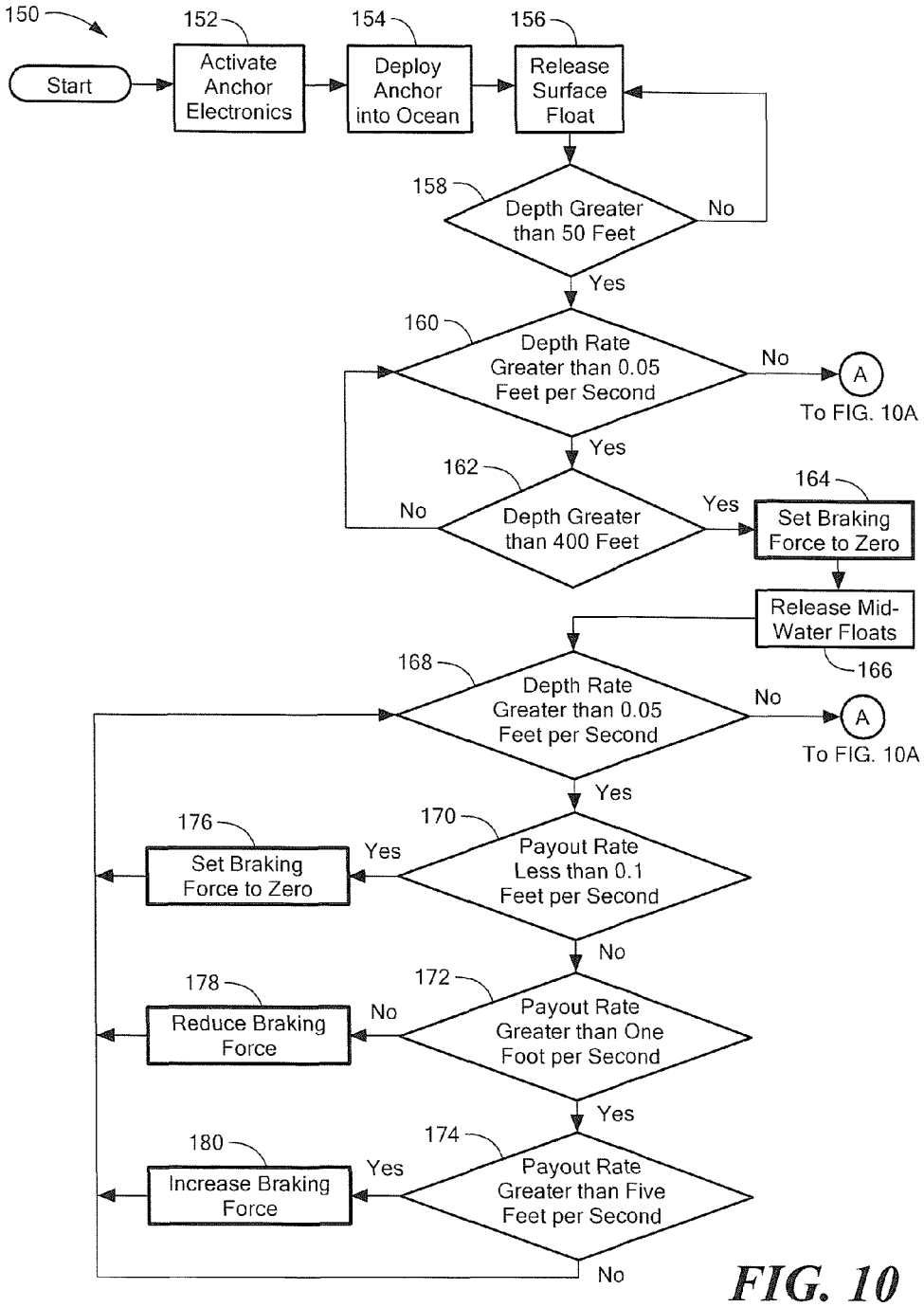
FIGS. 10 and 10A together are a flow chart showing a deployment sequence of the anchor of FIG. 1.
Figure 10A:
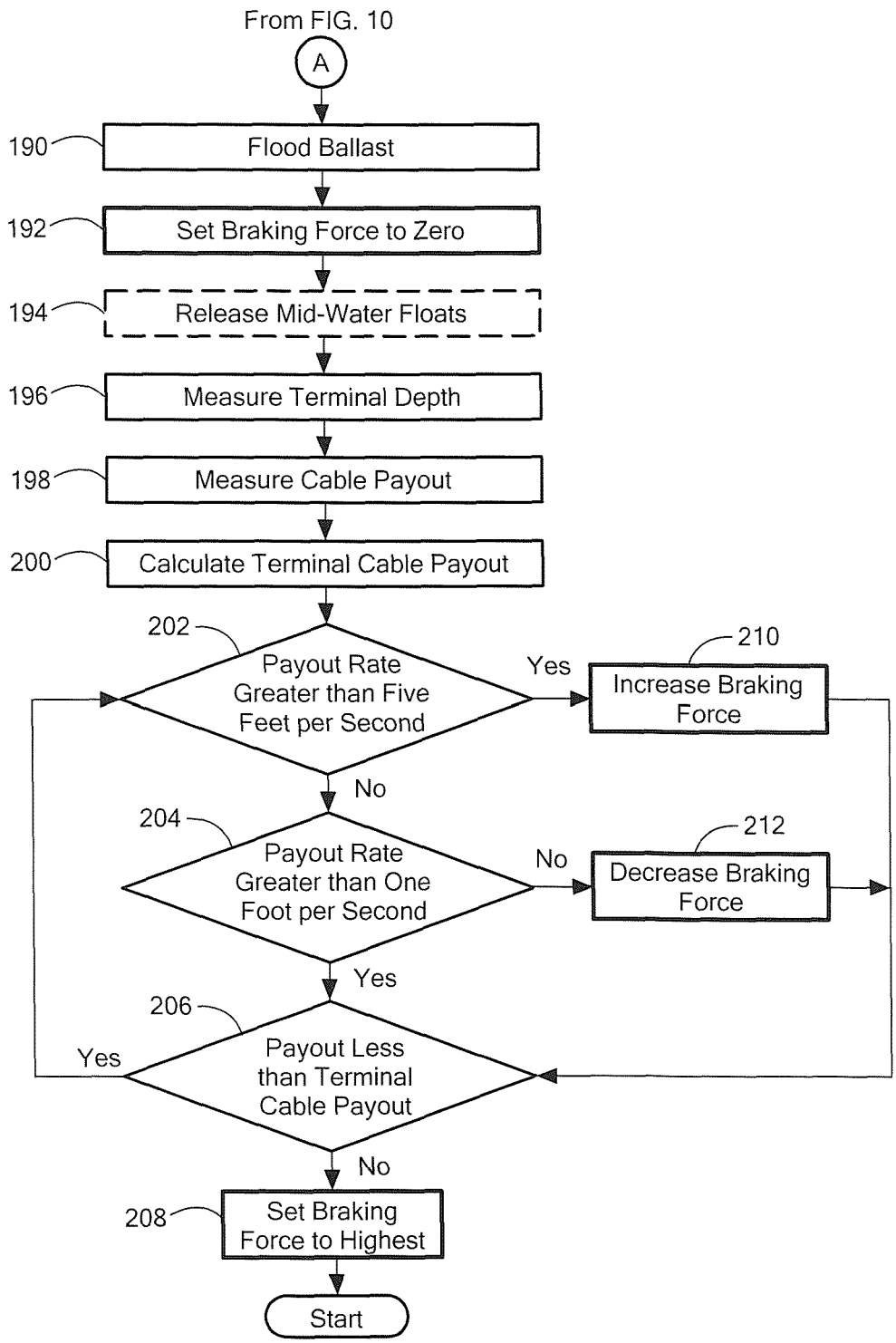

It should be appreciated that FIGS. 10 and 10A show flowcharts corresponding to the below contemplated technique which would be implemented in the electronics assembly 40' (FIG. 3). Rectangular elements (typified by element 152 in FIG. 10), herein denoted "processing blocks," represent computer software instructions or groups of instructions. Diamond shaped elements (typified by element 160 in FIG. 10), herein denoted "decision blocks," represent computer software instructions, or groups of instructions, which affect the execution of the computer software instructions represented by the processing blocks.

Alternatively, the processing and decision blocks represent steps performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required of the particular apparatus. It should be noted that many routine program elements, such as initialization of loops and variables and the use of temporary variables are not shown. It will be appreciated by those of ordinary skill in the art that unless otherwise indicated herein, the particular sequence of blocks described is illustrative only and can be varied without departing from the spirit of the invention. Thus, unless otherwise stated the blocks described below are unordered meaning that, when possible, the steps can be performed in any convenient or desirable order.

Referring to FIG. 10, an exemplary method 150 of deploying an anchor, for example the anchor 10' of FIGS. 2 and 3, begins at block 152, where the anchor 10' is initially activated. The anchor can be stowed for long periods of time without activation, and therefore, the power source 34' (FIG. 2) can remain fully charged during stowage. Activation can include, for example, turning on the electronic assembly 40' (FIG. 3) and turning on the float 20' (FIG. 3).

At block 154, the anchor 10' is physically deployed into the ocean. The anchor 10' can be slid into the ocean down a ramp, deployed from a crane or the like, or placed manually into the ocean.

At block 156, the float 20' (FIG. 2) is released from the anchor 10', for example via the release mechanism 58' of FIG. 4 under control of the electronic assemble 40' (FIG. 3). In some embodiments, a time of the release of the floats 20' can be at a fixed time after the float 20' is activated at block 152. In other embodiments, the float 20' can be released when the anchor senses being in the ocean, for example with a seawater switch or the like.

At block 158, it is sensed by the anchor, for example via the depth sensor 41' of FIG. 3, whether the anchor 10' is at a depth greater that fifty feet. If the depth is greater than fifty feet, it is then sensed at block 160 whether the depth rate of increase is greater than 0.05 feet per second. If the depth rate of increase is greater than 0.05 feet per second, it is then sensed at block 162 whether the depth is greater than four hundred feet. If the depth is greater than four hundred feet, then the deployment is of a type described for deep depths in conjunction with FIG. 7. As described above in conjunction with FIG. 3, the front ballast tank (e.g., 49' of FIG. 3) can begin filling via a pressure-released poppet valve as the anchor 10' descends through the water.

If the depth is greater than four hundred feet, at block 164, the mid-water floats 16*a*', 16*b*' (FIGS. 2 and 3) are released, for example, by the release mechanism 80' of FIGS. 5 and 5A, which can be, as described above, released by mechanical means by a tug on the cord 82' by the tether cable 12*b*'. As described above in conjunction with FIG. 3, the front ballast tank (e.g., 49', FIG. 3) can be approximately full at the time that the mid-water floats are released.

At block 166, the braking force applied by the brakes 100*a*', 100*b*' (FIG. 4) to the capstan 102' (FIG. 4) is set to zero. At this time, the riser cable 12*a*' (FIGS. 2 and 3) begins to deploy via the capstan 30' due to the positive buoyancy of the mid-water floats 16*a*', 16*b*'. The brakes 100*a*', 100*b*' can come under control of the electronic assembly 40' upon sensing the deployment of the mid-water floats, for example, via the release sensor 84' of FIG. 5A.

At block 168, it is again sensed whether the depth rate of increase of the anchor 10' is greater than 0.05 feet per second. If the depth rate of increase is greater than 0.05 feet per second, then at block 170, via the rotation sensor 104' of FIG. 6 or via the payout length sensor 106' of FIG. 6, it is detected via the electronic assembly 40' of FIG. 3 whether the payout rate of the riser cable 12*a*' (FIG. 2) is less than 0.1 feet per second. If the payout rate of the riser cable 12*a*' is not less than 0.1 feet per second, then at block 172 it is detected whether the payout rate of the riser cable 12*a*' is greater than one foot per second. If the payout rate of the riser cable 12*a*' is greater than one foot per second, then at block 174 it is detected whether the payout rate of the riser cable 12*a*' is greater than five feet per second. If the payout rate of the riser cable 12*a*' is not greater than five feet per second, then the process returns to block 168.

If at block 170, the payout rate of the riser cable 12*a*' is less than 0.1 feet per second, then the braking force applied by the brakes 100*a*', 100*b*' (FIG. 4) to the capstan 102' is set to zero at block 176, and the process returns to block 168.

If at block 172, the payout rate of the riser cable 12*a*' is not greater than one foot per second, then the braking force applied by the brakes 100*a*', 100*b*' (FIG. 4) to the capstan 102' is reduced at block 178, but not below zero braking force, and the process returns to block 168.

If at block 174, the payout rate of the riser cable 12*a*' is greater than five feet per second, then the braking force applied by the brakes 100*a*', 10*b*' (FIG. 4) to the capstan 102' is increased at block 180, but not above the highest braking force, and the process returns to block 168.

With the above arrangement, it will be understood that payout rate of the riser cable 12*a*' should be held to between one foot per second and five feet per second as the anchor 10' deploys to its final terminal depth.

At block 162, if the depth is not greater than four hundred feet, the process returns to block 160.

At blocks 160 and 168, if the depth rate is not greater than 0.05 feet per second, i.e., if the anchor 10' has landed on the bottom of the ocean, then the process continues to block 190 of FIG. 10A.

Referring now to FIG. 10A, the process 150 of FIG. 10 continues at block 190, wherein the rear ballast tanks (e.g., 46*a*', 46*b*', FIG. 3) are flooded. Block 190 can be achieved via block 160 of FIG. 10, in which case the deployment has occurred in relatively shallow water, e.g., water having a depth less than four hundred feet. Block 190 can also be achieved via block 168 of FIG. 10, in which case the deployment has occurred in relatively deep water, e.g., water having a depth greater than four hundred feet.

The processes blocks of FIG. 10A represent what operations the anchor undertakes when it reaches the ocean bottom, either in shallow water or in deep water.

At block 192, the braking force applied by the brakes 100*a*', 100*b*' (FIG. 4) to the capstan 102' (FIG. 4) is set to zero.

At block 192, if the deployment was in relatively shallow water, the anchor may sit on the bottom of the ocean until, after some time period, at block 194, the mid-water floats 16*a*', 16*b*' are released by the action of wind and waves upon the float 20.

If the deployment was in relatively deep water, the mid-water floats 16*a*', 16*b*' were already released at block 166 of FIG. 10, and the release at block 194 is not performed.

At block 196, a terminal depth, D, is measured, i.e., the depth at which the anchor resides on the ocean bottom, via the depth sensor 41' of FIG. 3.

At block 198, the payout length of the riser cable, L, is measured according to the rotation signal generated by the rotation sensor 104' associated with the capstan 102' or according to the payout length signal generated by the payout length sensor 106', all described above in conjunction with FIG. 6. It will be understood how to calculate the payout length from the rotation signal, if a diameter of the capstan hub 102*a*' (FIG. 6) is known.

At block 200, a desired terminal payout length of the riser cable is calculated. In some embodiments, the desired terminal payout length of the riser cable is calculated as a sum of the measured payout length, L, plus a desired adjustment length, A, i.e., L+A.

In some arrangements, the desired adjustment length, A is calculated as:

$$A=(D-y)-(L),$$

where

D=depth of anchor 10'

L=measured payout length of riser cable y=predetermined constant, for example, two hundred feet Knowing the desired adjustment length, it will be understood how to then measure subsequent amounts of the riser cable payed out at blocks 200-204 from the rotation signal or from the payout length signal.

At block 200, if the payout rate of the riser cable 12*a*' according to the rotation signal or according to the payout length signal is not greater than five feet per second, then the process proceeds to block 204.

At block 204, if the payout rate of the riser cable 12*a*' is greater than one foot per second, then the process continues to block 206.

At block 206, if the total measured payout of the riser cable is less than the desired terminal payout length, i.e., L+A, then the process returns to block 202.

At block 206, if the total measured payout of the riser cable 12*a*' is not less than the desired terminal payout length, L+A, i.e., if the desired terminal payout length of the riser cable 12*a*' has been achieved, then at block 208, the braking force applied by the brakes 100*a*', 100*b*' is set to a highest braking force, at which point the process ends and the deployment of the riser cable 12*a*' is complete.

At block 202, if the payout rate of the riser cable 12*a*' is greater than five feet per second, then at block 210, the braking force is increased and the process proceeds to block 206.

At block 204, if the payout rate of the riser cable 12*a*' is not greater than one foot per second, then at block 212, the braking force is decreased and the process proceeds to block 206.

With the above arrangement, it will be understood that payout rate of the riser cable 12*a*' should be held to between one foot per second and five feet per second as the riser cable 12*a*' deploys to its final terminal length. With the final terminal length of the riser cable 12*a*', the anchor 10 achieves the configuration as shown in FIG. 1, for which the mid-water floats 16*a*, 16*b* are under the surface of the water.

While particular numerical values for rates and depths are described above in conjunction with FIGS. 10 and 10A, it will be understood that other rates and depths can be substituted without changing the spirit of the invention. Also, while a particular process is described above, it will be appreciated that the above process can be modified or other processes can be substituted so as to achieve the desired configuration of FIG. 1, having the mid-water floats 16*a*, 16*b* beneath the surface of the ocean and at a desired depth.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An anchor, comprising:

a frame;

a capstan coupled to the frame, wherein the capstan comprises a capstan shaft and a capstan hub coupled to the capstan shaft, wherein the capstan hub is configured to rotate about the capstan shaft;

a riser cable in contact with the capstan hub, wherein the capstan is configured to deploy the riser cable from the anchor around the capstan hub;

at least one brake coupled to the capstan shaft or to the capstan hub;

a processor configured to provide a braking control signal to the at least one brake, wherein the at least one brake is configured, in response to the braking control signal, to retard a speed of rotation of the capstan hub, resulting in at least one of a retardation of a speed of deployment of the riser cable or a retardation of a speed of decent of the anchor; and a float, wherein the anchor is configured to hold the float, wherein the anchor is configured to deploy the float from the anchor.

2. The anchor of claim 1, wherein the at least one brake comprises two brakes coupled adjacent to opposite ends of the capstan shaft, respectively, wherein the capstan hub is disposed between the two brakes.

3. The anchor of claim 2, wherein each one of the two brakes is configured to be able, in response to the braking control signal, to apply to the capstan hub at least a zero braking force, a first braking force greater than the zero braking force, and a second braking force greater than the first braking force, wherein different combinations of the braking forces of the two brakes results in at least the zero braking force, a low braking force, a medium braking force, a high braking force, and a highest braking force.

4. The anchor of claim 3, wherein the first braking force is about half of the second braking force.

5. The anchor of claim 3, wherein the low braking force, the medium braking force, and the high braking force, are about a quarter, a half, and three quarters of the highest braking force, respectively.

6. The anchor of claim 1, wherein the at least one brake is configured to be able, in response to the braking control signal, to apply to the capstan hub a variable braking force.

7. The anchor of claim 1, wherein the at least one brake is configured to be able, in response to the braking control signal, to apply to the capstan hub at least a zero braking force, a low braking force, a medium braking force, a high braking force, and a highest braking force.

8. The anchor of claim 7, further comprising:

a depth sensor coupled to the anchor and configured to generate a depth information signal, wherein the processor is coupled to receive the depth information signal and configured to provide the braking control signal to the at least one brake in relation to the depth information signal.

9. The anchor of claim 7, further comprising:

at least one of a rotation sensor or a payout length sensor coupled to the capstan and configured to generate a respective at least one of a rotation signal in relation to a speed of payout of the riser cable around the capstan or a payout length signal in relation to a payout length of the riser cable, wherein the processor coupled to receive the at least one of the rotation signal or the payout length signal and configured to provide the braking control signal to the at least one brake in relation to the at least one of the rotation signal or the payout length signal.

10. The anchor of claim 7, further comprising:

a depth sensor coupled to the anchor and configured to generate a depth information signal; and at least one of a rotation sensor or a payout length sensor coupled to the capstan and configured to generate a respective at least one of a rotation signal in relation to a speed of payout of the riser cable around the capstan or a payout length signal in relation to a payout length of the riser cable, wherein the processor coupled to receive the at least one of the rotation signal or the payout length signal and configured to provide the braking control signal to the at least one brake in relation to the depth information signal and in relation to the at least one of the rotation signal or the payout length signal.

11. The anchor of claim 10, wherein the float is a surface float, the anchor further comprising:

a tether cable coupled in series with the riser cable and coupled to the float; and a mid-water float coupled between the riser cable and the tether cable.

12. The anchor of claim 11, wherein, during a first portion of an anchor deployment, the anchor is configured to deploy the surface float from the anchor, the anchor is configured to descend through the ocean, and the anchor is configured to deploy the tether cable, wherein, during a second portion of the anchor deployment, the anchor is upon the bottom of the ocean, wherein, during a third portion of the anchor deployment, the anchor is configured to deploy the mid-water float from the anchor, and the anchor is configured to deploy the riser cable from around the capstan hub, and wherein, during a fourth portion of the anchor deployment, the anchor is upon the bottom of the ocean, and the anchor is configured to stop deployment of the riser cable from around the capstan hub, wherein, during the third portion of the anchor deployment, the processor is configured to select, in relation to at least one of the rotation signal or the payout length signal, a first determined braking force from among the zero braking force, the low braking force, the medium braking force, the high braking force, and the highest braking force, in order to result in a predetermined total payout length of the riser cable, and the processor is configured to generate the braking control signal in accordance with the selected first determined braking force, and wherein, during the fourth portion of the anchor deployment, the processor is configured to select a second determined braking force from among the zero braking force, the low braking force, the medium braking force, the high braking force, and the highest braking force, in order to result in no payout of the riser cable, and the processor is configured to generate the braking control signal in accordance with the selected second determined braking force.

13. The anchor of claim 11, wherein, during a first portion of the anchor deployment, the anchor is configured to deploy the surface float from the anchor, the anchor is configured to descend through the ocean, and the anchor is configured to deploy the tether cable, wherein, during a second portion of the anchor deployment, the anchor is configured to deploy the mid-water float from the anchor, the anchor is configured to descend through the ocean, and the anchor is configured to deploy the riser cable from around the capstan hub, wherein, during a third portion of the anchor deployment, the anchor is upon the bottom of the ocean, and the anchor is configured to deploy the riser cable from around the capstan hub, wherein, during a fourth portion of the anchor deployment, the anchor is upon the bottom of the ocean, and the anchor is configured to stop deployment of the riser cable from around the capstan hub, wherein, during the second portion of the anchor deployment, the processor is configured to select, in relation to at least one of the rotation signal or the payout length signal, a first determined braking force from among the zero braking force, the low braking force, the medium braking force, the high braking force, and the highest braking force, in order to result in a predetermined payout rate of the riser cable, and the processor is configured to generate the braking control signal in accordance with the selected first determined braking force, wherein, during the third portion of the anchor deployment, the processor is configured to select, in relation to at least one of the rotation signal or the payout length signal, a second determined braking force from among the zero braking force, the low braking force, the medium braking force, the high braking force, and the highest braking force, in order to result in a predetermined total payout length of the riser cable, and the processor is configured to generate the braking control signal in accordance with the selected second determined braking force, and wherein, during the fourth portion of the anchor deployment, the processor is configured to select a third determined braking force from among the zero braking force, the low braking force, the medium braking force, the high braking force, and the highest braking force, in order to result in no payout of the riser cable, and the processor is configured to generate the braking control signal in accordance with the selected third determined braking force.

14. The anchor of claim 8, further comprising:

a deployment mechanism coupled to the float and to the frame, wherein the processor is configured to generate a deployment signal at a predetermined time delay from a time that the anchor is energized, and wherein the deployment mechanism is coupled to receive the deployment signal and to release the float from the frame in response to the deployment signal.

15. A method of deploying an ocean anchor for anchoring a float, comprising:

releasing the float;

measuring a rate of decent of the anchor;

releasing a mid-water float;

measuring a payout rate or a payout length of a riser cable coupled at one end to the anchor and at the other end to the mid-water float;

selecting a braking value in accordance with at least one of the rate of decent, the payout rate, or the payout length;

generating a braking signal in accordance with the braking value; and applying the braking signal to one or more brakes associated with the riser cable.

16. The method of claim 15, further comprising:

measuring a depth of the anchor; and detecting if the depth of the anchor is greater than a predetermined depth; wherein the releasing the mid-water float comprises:

releasing the mid-water float from the anchor in response to the depth of the anchor being greater than the predetermined depth.

17. The method of claim 15, further comprising:

determining if the payout rate is greater than a predetermined payout rate threshold value and if the payout length is greater than a predetermined payout length threshold value, wherein the selecting the braking value comprises selecting a first braking value if the payout rate is not greater than the predetermined payout rate threshold value and if the payout length is not greater than the predetermined payout length threshold value and selecting a second braking value if the payout rate is greater than the predetermined payout rate threshold value and if the payout length is not greater than the predetermined payout length threshold value.

18. The method of claim 15, further comprising:

detecting when the rate of decent falls below a predetermined threshold value;

measuring a depth of the anchor and a payout length of the riser cable at a time when the rate of decent falls below the predetermined threshold value;

calculating a total desired terminal payout length of the riser cable in accordance with the measured depth;

allowing the riser cable to further pay out while selecting the braking value to be a first predetermined braking value until the total desired terminal payout length is achieved; and stopping the riser cable payout after the total desired terminal payout is achieved while selecting the braking value to be a second predetermined braking value.

19. The method of claim 18, further comprising:

flooding a ballast tank upon the anchor when the rate of decent of the anchor falls below the predetermined threshold value.

20. The method of claim 15, wherein the braking signal is operable to result in the brakes applying a braking force selected from among at least a zero braking force, a first braking force greater than the zero braking force, and a second braking force greater than the first braking force.

21. The method of claim 15, wherein the braking signal is operable to result in the brakes applying a braking force selected from among at least a zero braking force, a low braking force, a medium braking force, a high braking force, and a highest braking force.

* * * * *